US007190244B2

(12) United States Patent
Hettak

(10) Patent No.: US 7,190,244 B2
(45) Date of Patent: Mar. 13, 2007

(54) REDUCED SIZE TRANSMISSION LINE USING CAPACITIVE LOADING

(75) Inventor: Khelifa Hettak, Nepean (CA)

(73) Assignee: Her Majesty the Queen in Right of Canada as represented by the Minister of Industry, through the Communications Research Centre Canada, Ottawa (CA)

( * ) Notice: Subject to any disclaimer, the term of this patent is extended or adjusted under 35 U.S.C. 154(b) by 7 days.

(21) Appl. No.: 10/990,489

(22) Filed: Nov. 18, 2004

(65) Prior Publication Data

US 2006/0103482 A1 May 18, 2006

(51) Int. Cl.
*H01P 5/02* (2006.01)

(52) U.S. Cl. ..... 333/263

(58) Field of Classification Search ..... 333/246, 333/238, 204, 161, 263, 116, 128, 136, 117
See application file for complete search history.

(56) References Cited

U.S. PATENT DOCUMENTS 4,127,832 A 11/1978 Riblet
6,549,089 B2 4/2003 Ashoka
6,674,347 B1 * 1/2004 Maruhashi et al. ..... 333/238

OTHER PUBLICATIONS

Hettak et al, "The use of uniplanar technology to reduced microwave circuit size", Microwave Journal, May 2001.
Sakagami et al, "Reduced branch-line coupler using eight two-step stubs", IEE Proc.- Microw. Antennas Propag., vol. 146, No. 6, Dec. 1999.
Hirota et al, "Reduced-size branch-line and rat-race hybrids for uniplanar MMIC's", IEEE Transactions On Microwave Theory And Techniques, vol. 38, No. 3, Mar. 1990.
T. Le Nadan et al, "Optimization and miniaturization of filter/antenna multi-function module using a composite ceramic/foam substrate", 1999 IEEE International Microwave Symposium.
J.Ph.Coupez, K.Hettak, Ch.Person, E.Rius, "Ultra Wideband Coplanar to Slotline Transition Using a Multi-Layer Multi-technology Approach", Microwave and Optronics MIOP 97, Sindelfigen Allemagne, Mar. 1997, pp. 428-432.
K. Hettak, G.A. Morin2 and M.G. Studbbs, "A Novel Compact Multi-Layer MMIC CPW Branchline Coupler Using Thin-Film Microstrip Stub Loading at 44 GHz", Microwave Symposium Digest, 2004 IEEE MTT-S International, pp. 327-330 vol. 1, Jun. 6, 2004.
M.Y. Lee and H.Y. Lee, "Characteristic of the Coplanar Waveguide to Microstrip Right- Angled Transition", 2000 Asia Pacific Microwave Conference, pp. 1-3.

(Continued)

*Primary Examiner*—Stephen E. Jones
(74) *Attorney, Agent, or Firm*—Teitelbaum & MacLean; Neil Teitelbaum; Doug MacLean

(57) ABSTRACT

A capacitively loaded multilevel transmission line network for operation at a microwave frequency f is disclosed wherein microstrip conductors are disposed over or under a uniplanar transmission line (UTL), electrically connected thereto at or near opposing ends of the UTL and coupled to portions of the UTL separated therefrom by a thin dielectric film. The microstrip conductors and the portions of the UTL coupled thereto form thin-film microstrip (TFMS) shunt stubs capacitively loading the ends of the UTL for increasing its electrical length. The present invention enables considerable size reduction of microwave circuits having uniplanar transmission lines.

21 Claims, 11 Drawing Sheets

OTHER PUBLICATIONS

J.H. Lee and H.Y. Lee, "Novel Quadrature Branch-Line Coupler Using CPW-to-Microstrip Transitions", 2000 IEEE MTT-S Digest, pp. 621-624.

W. Menzel and W. Schwab, "Compact Multilayer Filter Structures for Coplanar MMIC's", IEEE Microwave and Guide Wave Letters, vol. 2, No. 12, Dec. 1992, pp. 497-498.

* cited by examiner

REDUCED SIZE TRANSMISSION LINE USING CAPACITIVE LOADING

CROSS-REFERENCE TO RELATED APPLICATIONS

N/A

FIELD OF THE INVENTION

The present invention relates generally to transmission line structures in microwave circuits and more particularly to multilayer transmission line structures that are capacitively loaded for the purpose of circuit size reduction.

BACKGROUND OF THE INVENTION

Transmission line structures in microwave circuits are often a large part of the overall circuit size. Since the cost of a microwave circuit generally increases as its size increases, minimizing the size of transmission line structures can be of significant importance for many applications of microwave circuits.

Physical size of a transmission line is usually governed by its desired electrical characteristics, and in many cases—by a target electrical length of the transmission line. The electrical length of a transmission line is proportional to a ration of its physical length to a wavelength of the guided electromagnetic mode propagating along the transmission line. For many applications, such as impedance matching or in a coupler, transmission lines of specific electrical lengths are required, limiting thus a minimum achievable circuit size for a type of transmission line used in a particular application. This size limitation can be overcome using a transmission line structure that is physically shorter and loading it with reactive loading to achieve an electrical length equivalent to a longer, unloaded transmission line.

Different lengths of transmission lines have different total inductances and total capacitances, and therefore perform differently even at the same frequency. The size-reduced transmission line structures can be made electrically equivalent to standard transmission lines by compensating for the lower total inductance and capacitance of a shortened transmission line relative to a longer transmission line. Hettak et al, in an article entitled "The use of uniplanar technology to reduced microwave circuit size", Microwave Journal, May 2001 which is included herein by reference, has shown that, whereas capacitively loading the ends of a shortened transmission line compensates for its lower total capacitance, the shortened transmission line has to have a higher characteristic impedance to compensate for its lower total inductance. This compensation results in a size-reduced structure having, at a pre-determined operating frequency, the same effective characteristic impedance and effective electrical length as a longer transmission line.

These size-reduced transmission line structures result in smaller circuits maintaining a target electrical performance within a given frequency range.

U.S. Pat. No. 4,127,832 issued to Riblet discloses a directional coupler preferably constructed in stripline or microstrip media comprising four sections of transmission line interconnected so as to form at their junctions four ports of the coupler, having four capacitive elements such as stripline or microstrip stubs connected at each junction so that physical length of the four sections of transmission line is reduced. In a similar approach, Sakagami et al, in an article entitled "Reduced branch-line coupler using eight two-step stubs", *IEE Proc.-Microw. Antennas Propag.*, Vol. 146, No. 6, December 1999, disclosed a shortened microstrip transmission line with capacitive loading using shunt microstrip stubs.

Hirota et al, in an article entitled "Reduced-size branch-line and rat-race hybrids for uniplanar MMIC's", IEEE Transactions On Microwave Theory And Techniques, Vol. 38, No. 3, March 1990, disclosed a shortened coplanar waveguide (CPW) transmission line with capacitive loading using shunt Metal-Insulator-Metal (MIM) capacitors.

Hettak et al, 2001, disclosed a shortened uniplanar transmission line with capacitive loading using shunt uniplanar stubs.

The aforementioned approaches to transmission line size reduction have their advantages and disadvantages.

MIM capacitors at high frequencies, for example, in microwave and millimeter-wave wavelength regions, can be difficult to model and may be susceptible to fabrication process deviations. In these instances, the electrical performance of a size-reduced transmission line may be negatively affected.

Standard microstrip stubs suffer from at least two negative aspects that limit a total amount of size reduction. Firstly, for a given amount of capacitive loading, a physical length of the stub providing the loading may offset the size reduction of the loaded line. Secondly, standard microstrip stubs must be placed far enough apart to prevent electromagnetic coupling between them, usually at least a substrate thickness apart. This minimum spacing also limits the total amount of size-reduction.

Using uniplanar stubs partially overcomes the limitations of standard microstrip stubs. Uniplanar stubs couple less to each other due to a uniplanar ground conductor that separates them. Uniplanar stubs can also have lower characteristic impedance compared to standard microstrip stubs. Hence, uniplanar transmission lines and stubs allows more significant size-reduction compared to standard microstrip media wherein signal and ground conductors are disposed on opposite sides of a relatively thick substrate. Nonetheless, size-reduction using uniplanar stubs is still limited by their minimum realizable characteristic impedance and a minimum spacing between them required for electromagnetic isolation.

Recently, microwave circuits combining uniplanar transmission lines and thin-film microstrip (TFMS) stubs were disclosed wherein the microstrip stubs have signal conductors disposed in a different layer than the uniplanar transmission lines. T. Le Nadan et al, in an article entitled "Optimization and miniaturization of filter/antenna multifunction module using a composite ceramic/foam substrate", 1999 IEEE International Microwave Symposium, disclosed using half-wavelength TFMS stub resonators connected to a uniplanar transmission line to form a band-pass filter connect to a patch antenna. TFMS stubs were used in Le Nadan solely to increase the isolation between the filter and the antenna.

SUMMARY OF THE INVENTION

It is therefore an object of this invention to provide multi-layer transmission line structures electrically equivalent to physically larger uniplanar transmission lines using short uniplanar transmission lines capacitively loaded by TFMS shunt stubs.

It is another object of this invention to provide a method of increasing electrical length of a uniplanar transmission line by capacitively loading thereof using TFMS stubs for use in size-reduced physically compact microwave circuits.

In accordance with the invention, a passive network for operating at a microwave operating frequency f is provided comprising a capacitively loaded transmission line, the capacitively loaded transmission line including: a first uniplanar transmission line having a characteristic impedance $Z_1$, a first end, a second end and an electrical length $\theta_1$ therebetween; a first microstrip conductor vertically offset from the first uniplanar transmission line, said first microstrip conductor electrically connected to the first uniplanar transmission line at one location at or near the first end and electromagnetically coupled to a first portion of the uniplanar transmission line at another location, wherein the first portion of the first uniplanar transmission line and the first microstrip conductor form a first microstrip shunt stub for capacitively loading the first uniplanar transmission line; there is further provided one of a short circuit electrically connected to the second end for short-circuiting the second end, and a second microstrip conductor vertically offset from the first uniplanar transmission line, said second microstrip conductor electrically connected to the first uniplanar transmission line at one location at or near the second end and electromagnetically coupled to a second portion of the uniplanar transmission line at another location, wherein the second portion of the first uniplanar transmission line and the second microstrip conductor form a second microstrip shunt stub for capacitively loading the first uniplanar transmission line; and wherein, at the operating frequency f, the capacitively loaded transmission line has a pre-determined characteristic impedance $Z_o$ that is less than $Z_1$ and an electrical length $\theta_0$ that is larger than $\theta_1$.

In accordance with one aspect of the invention, the microstrip shunt stubs at the operating frequency f are thin-film microstrip shunt stubs having a characteristic impedance $Z_s$ that is less than 20 Ω and an electrical length θs substantially equal to arctan $$\left(\frac{Z_s}{Z_1}\frac{\cos(\theta_1)-\cos(\theta_0)}{\sin(\theta_1)}\right)$$

at the operating frequency f, and the characteristic impedance of the first uniplanar transmission line $Z_1$ satisfies a relation $$Z_1 = Z_0 \cdot \frac{\sin(\theta_0)}{\sin(\theta_1)}.$$

In accordance with another aspect of this invention, a method is provided for increasing the electrical length of a uniplanar transmission line operating at an operating frequency f to an increased electrical length $\theta_0$, said uniplanar transmission line having a first end and a second end, the method comprising the steps of:

a) providing the uniplanar transmission line having a characteristic impedance $Z_1$ at the operating frequency f and an electrical length $\theta_1<\theta_0$ at the operating frequency f;

b) providing a first thin-film microstrip shunt stub electrically connected to the uniplanar transmission line at one location at or near the first end for capacitively loading the uniplanar transmission line, said first thin-film microstrip shunt stub comprising a microstrip conductor coupled to a first portion of the uniplanar transmission line at another location;

c) providing a second thin-film microstrip shunt stub electrically connected to the uniplanar transmission line at one location at or near the second end for capacitively loading the uniplanar transmission line, said second thin-film microstrip shunt stub comprising a microstrip conductor coupled to a second portion of the uniplanar transmission line at another location;

wherein the characteristic impedance $Z_1$, characteristic impedances and electrical lengths of the first and second microstrip shunt stubs are such that the uniplanar transmission line and the microstrip shunt stubs at the operating frequency f form a transmission line having the increased electrical length $\theta_0>\theta_1$ between the two ends and a predetermined characteristic impedance $Z_0<Z_1$; and wherein the step (c) is only performed when the second end is not shorted.

In accordance with another aspect of this invention, a passive network for operating at a microwave operating frequency f is provided, the passive network having first, second, third and fourth ports, the passive network comprising:

a) a first uniplanar transmission line electrically connecting the first and second ports;

b) a second uniplanar transmission line electrically connecting the third and fourth ports;

c) a third uniplanar transmission line electrically connecting the first and third ports;

d) a fourth uniplanar transmission line electrically connecting the second and fourth ports;

e) a first thin film microstrip shunt stub electrically connected to one of the first uniplanar transmission line and the third uniplanar transmission line at or near the first port for capacitively loading the first and third uniplanar transmission lines;

f) a second thin film microstrip shunt stub electrically connected to one of the first uniplanar transmission line and the forth uniplanar transmission line at or near the second port for capacitively loading the first and fourth uniplanar transmission lines;

g) a third thin film microstrip shunt stub electrically connected to one of the second uniplanar transmission line and the third uniplanar transmission line at or near the third port for capacitively loading the second and third uniplanar transmission lines;

h) a fourth thin film microstrip shunt stub electrically connected to one of the second uniplanar transmission line and the fourth uniplanar transmission line at or near the fourth port for capacitively loading the second and fourth uniplanar transmission lines;

wherein the first, second, third and fourth uniplanar transmission lines, and the first, second, third, and fourth microstrip stubs have a common ground conductor; wherein the first and second uniplanar transmission lines have a first characteristic impedance and a first electrical length smaller than 90°, and the third and fourth uniplanar transmission lines have a second characteristic impedance and a second electrical length smaller than 90°;

wherein the third port is electrically connected to a substantially 50Ω load; and wherein the first characteristic impedance, first electrical length, second characteristic impedance, second electrical length and the capacitive loading by the first, second, third and fourth thin film microstrip stubs are such that the passive network is capable of operating as a branchline coupler.

BRIEF DESCRIPTION OF THE DRAWINGS

Exemplary embodiments of the invention will now be described in conjunction with the drawings in which.

DETAILED DESCRIPTION OF THE PREFERRED EMBODIMENTS

Figure 1A:
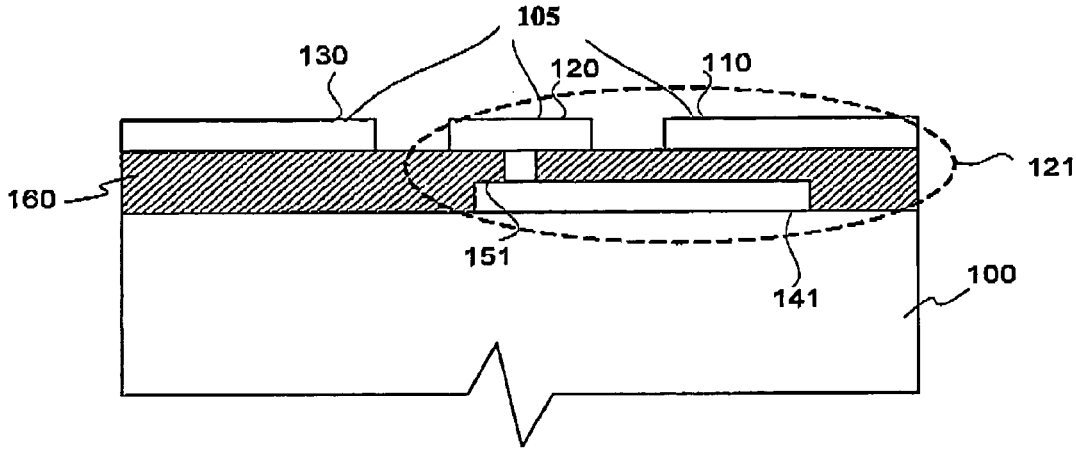
FIG. 1A is a diagram of a cross-sectional view of a uniplanar transmission line capacitively loaded by TFMS stubs.
Figure 1B:
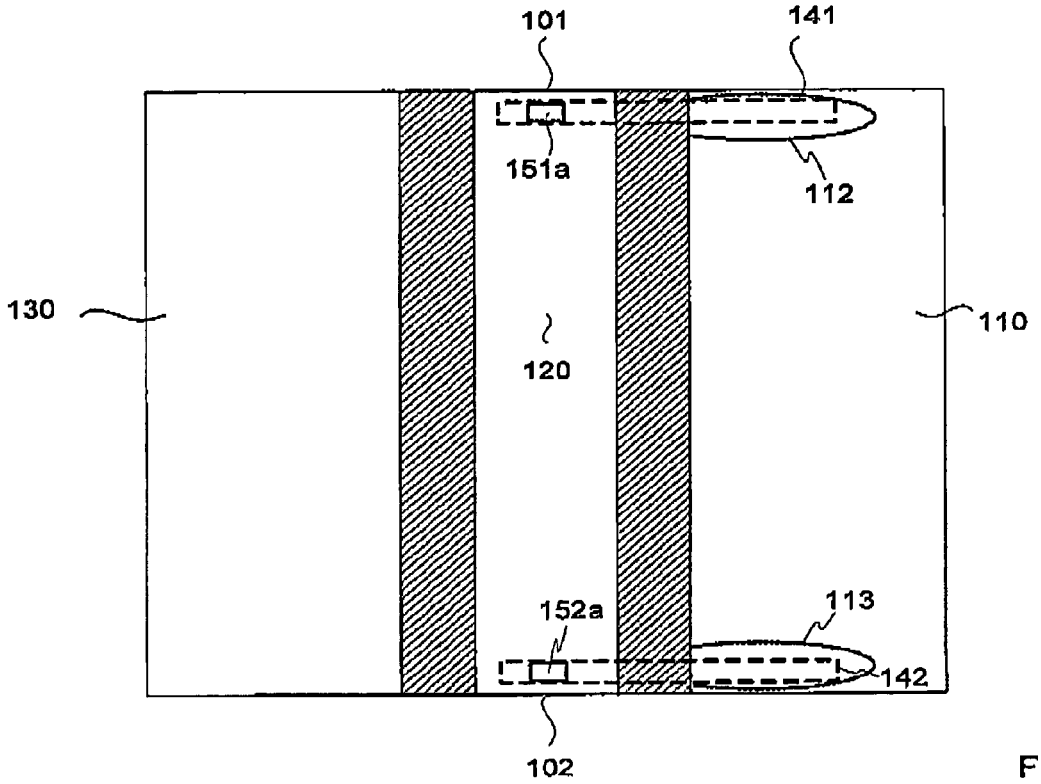
FIG. 1B is a diagram of a top view of the capacitively loaded transmission line shown in FIG. 1A.

A first exemplary embodiment of a passive network of the present invention is a multi-layer capacitively loaded transmission line which is shown in FIGS. 1A and 1B, which will now be discussed.

With reference to FIG. 1A, a first uniplanar transmission line (UTL) 105 is embodied as a coplanar waveguide (CPW) formed by a signal conductor 120 and two ground conductors 130 and 110 on a thin dielectric film 160 supported by a substrate 100. The thin dielectric film 160 can be a single layer of a dielectric material or be formed by multiple layers of dielectric materials. The signal conductor 120 is disposed between the ground conductors 130 and 110 at a distance therefrom, and is typically narrower than the ground conductors. The top view of the first UTL 105 is shown in FIG. 1B, also showing a first end 101 and a second end 102 thereof for connecting to other elements of a larger microwave circuit such as input/output ports, other transmission lines, antennas, transistors etc.

Turning back to FIG. 1A, a first microstrip conductor 141 is disposed over the substrate 100 so that it is vertically offset from the UTL conductors and is separated therefrom by the thin dielectric film 160. The first microstrip conductor 141 is connected to the CPW signal conductor 120 at a first location 151*a* near the first end 101 of the UTL 105 by a via conductor 151 through the dielectric film 160. The first microstrip conductor 141 is oriented to extend into a region under a first portion 112 of the ground conductor 110. The first microstrip conductor 141 and the first portion 112 of the ground conductor 110 are electromagnetically coupled through the thin dielectric film 160 forming a first open-circuit (o/c) thin-film microstrip (TFMS) shunt stub 121. In operation, the o/c TFMS shunt stub 121 provides capacitive loading of the first end 101 of the UTL 105.

Note that in the context of this specification, two conductors of a microwave circuit are referred to as being electromagnetically coupled to each other, if they form a pair of conductors, commonly referred to as signal and ground conductors, of a microwave waveguide capable of supporting an electromagnetic mode at an operating frequency of the microwave circuit.

Similarly, a second microstrip conductor 142 is disposed over the substrate 100 near the second end 102 of the UTL 105, so that it is vertically offset from the UTL conductors and is separated therefrom by the thin film 160. The second microstrip conductor 142 is connected to the central signal conductor 120 at a location 152*a* near the second end 102 of the UTL 105 by a via conductor 152*a* through the dielectric film 160. The second microstrip conductor 142 is oriented to extend into a region under a second portion 113 of the ground conductor 110. The second wicrostrip conductor 142 and the second portion 113 of the ground conductor 110 are electromagnetically coupled through the thin dielectric film 160 forming a second o/c TFMS shunt stub for capacitively loading the second end of the UTL 105.

Alternatively, the microstrip conductors 141 and 142 can be extended under the ground conductor 130 to form two TFMS shunt stubs for capacitively loading the UTL 105. Also, two TFMS shunts stubs may be located at each end 101 or 102 extending under ground conductors 130 and 110 respectively wherein their parallel combination is equivalent to a single TFMS stub under ground conductors 110 or 130.

The aforedescribed capacitive loading using TFMS shunt stubs, in combination with an appropriate change of the UTL impedance as described hereinafter, has an effect of increasing the electrical length of the UTL as seen from the outside network, and thus can be used for size reduction of microwave circuits wherein a UTL of a particular electrical length is required by design. It however differs from previously published techniques wherein the capacitive loading for size reduction was realized by using other types of shunt stubs, such as uniplanar and standard microstrip stubs, and enables more size reduction as explained hereafter in this specification.

TFMS transmission lines in general, and TFMS stubs in particular, are miniaturized versions of standard microstrip lines. Like a microstrip line, a TFMS line is formed by two conductors vertically separated from each other by a separating transmission medium such as a dielectric or semiconductor layer and commonly referred to as a signal conductor and a ground conductor. Unlike a standard microstrip line, however, the separating transmission medium for a TFMS line is a very thin, dielectric film. Preferably this thickness is about 1 micron or less. Previously, TFMS lines have been used on low-resistivity silicon wafers because the metal ground plane of the TFMS line can isolate the transmission line from the lossy silicon. For size-reduction of transmission lines, however, a primary advantage of using the TFMS shunt stubs is a low characteristic impedance of TFMS due to their thin dielectric film.

The TFMS shunt stubs used in this invention differ somewhat from traditional thin film microstrip structures, as they use a portion of the uniplanar transmission line as a second, typically but not exclusively ground, conductor. In the first embodiment shown in FIGS. 1A and 1B, the microstrip conductors 141 and 142 are the signal conductors of the corresponding TFMS shunt stubs 121 and 122, which are coupled to the ground conductor 110 of the UTL 105. In operation, the ground conductor 110 provides a ground potential required to support microwave propagation modes coupled to each of the microstrip conductors 141 and 142. The ground conductor 110 of the UTL 105 is therefore also a ground conductor of the first and second TFMS shunt stubs. In the configuration shown in FIGS. 1A, B, the microstrip conductors 141 and 142 share thus a ground conductor with the UTL 105.

The vertically offset microstrip conductors of the TFMS shunt stubs are preferably located under the uniplanar transmission line conductors as shown in FIG. 1A; alternatively they could be located above the UTL conductors as long as there is a thin dielectric material between the microstrip conductors and the UTL conductors.

Electrical performance of a uniform transmission line at microwave frequencies is commonly described by two parameters: an electrical length $\theta_0$, defined as an end-to-end phase accrual of a microwave signal propagating through the transmission line, and a characteristic impedance $Z_o$. Electrical properties of a more general two-port network can be described by a set of parameters known in the art as ABCD parameters, also know as a Transmission Matrix, relating electrical current and voltage at one port of the network to electrical current and voltage at the other port of the network. In a particular case of a uniform lossless transmission line having the electrical length θ and the characteristic impedance Z, the ABCD parameters satisfy the relations (2):

$$A=\cos\theta,\ B=jZ\sin\theta,\ C=(j/Z)\sin\theta,\ D=\cos\theta. \tag{2}$$

Electrical performance of the capacitively-loaded UTL 105 approximates the performance of a uniform transmission line having an electrical length $\theta_o$ and a characteristic impedance $Z_o$ at an operating frequency f, if the ABCD parameters of the capacitively-loaded UTL 105 at the operating frequency f satisfy relations (2) with $\theta=\theta_o$ and $Z=Z_o$. The parameters $\theta_o$ and $Z_o$ are referred to hereafter in this specification as a target electrical length and a target characteristic impedance of the capacitively loaded UTL at the operating frequency f. At microwave frequencies, the ABCD parameters are typically not measured directly, but calculated from measured s-parameters of the network using known-in-the-art mathematical formulas. In a particular microwave circuit, $Z_o$ and $\theta_o$ are often pre-determined at a design stage by a function of the transmission line in the circuit; for example, transmission lines having $Z_0$=50 Ohm and $\theta_0$=90° are preferably required in a directional coupler.

The UTL 105 is physically shorter than an equivalent uniform UTL having the electrical length $\theta_o$ and the characteristic capacitance $Z_o$, and therefore has an electrical length $\theta_1$ that is smaller than $\theta_o$. To compensate for a smaller distributed inductance resulting from a smaller physical length, the UTL 105 has a characteristic impedance $Z_1$ which is larger than $Z_o$ and satisfies at the operating frequency f an expression (3):

$$Z_1 = Z_0 \cdot \frac{\sin(\theta_0)}{\sin(\theta_1)} \tag{3}$$

Similarly, to compensate for a smaller distributed capacitance of the shorter UTL 105, electrical length θs of each of the TFMS shunt stubs 121 and 122 has to satisfy an expression (4) to provide a correct amount of capacitive loading:

$$\theta_s = \arctan\left(\frac{Z_s}{Z_0}\frac{\cos(\theta_1)-\cos(\theta_0)}{\sin(\theta_0)}\right), \tag{4}$$

where Zs is a characteristic impedance of the shunt stubs. For a case when θo=90°, as in a directional coupler, expressions (3) and (4) were derived By Hettak et al., 2001.

It follows from expression (4) that a smaller $Z_s$ leads to a smaller $\theta_s$, and therefore to shorter shunt stubs when other parameters in (4) are fixed. Therefore, shunt stubs that have a smaller characteristic impedance when used for capacitive loading of a transmission line, provide opportunities for a greater circuit size reduction.

Advantageously, the TFMS stubs of the present invention, for example the TFMS shunt stubs 121 and 122 shown in FIGS. 1A and 1B, have a much lower characteristic impedances $Z_s$ compared to typical values of standard microstrip. Preferably, $Z_s$ is about or less than 20 Ohm, due to a small, about or less than 1 micron, thickness of the dielectric film 160 separating their signal and ground conductors. Therefore, a more capacitive loading can be provided using TFMS shunt stubs compared to the standard microstrip or CPW shunt stubs of prior art, thus enabling more size-reduction of the passive network. Furthermore, the microstrip conductors 110 and 130 are more electromagnetically isolated from each other than for example standard microstrip stubs would be if separated by the same distance, due to the small separation of the TFMS conductors from their ground, and providing an additional advantage for circuit size reduction.

Figure 2:
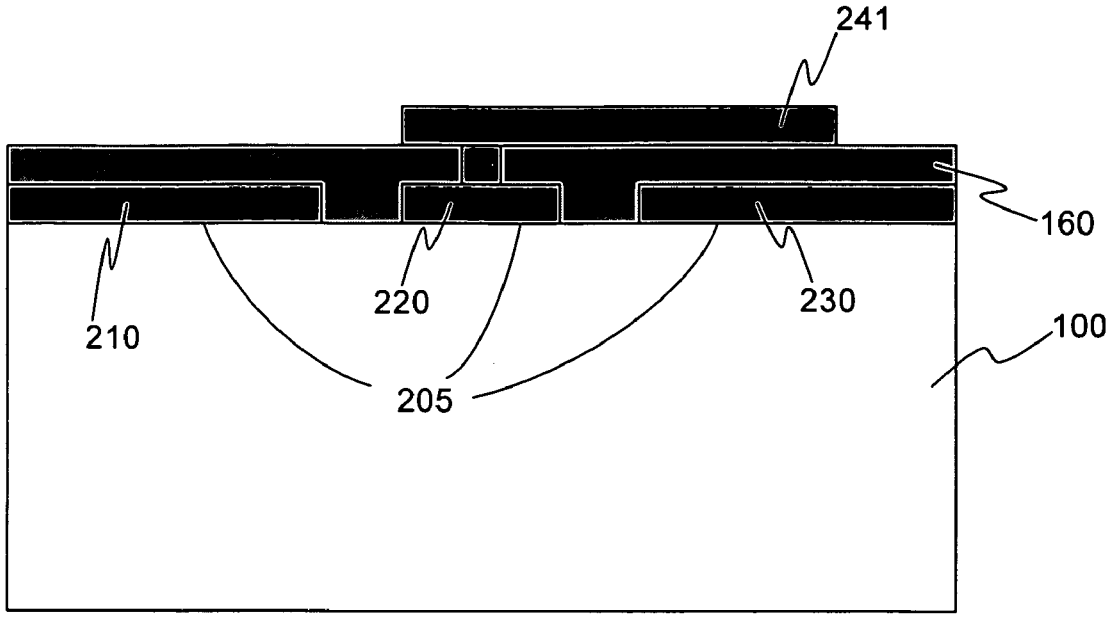
FIG. 2 is a diagram of a cross-sectional view of a capacitively loaded transmission line.

Variations of the aforedescribed basic multilayer structure shown in FIGS. 1A and 1B are of course possible. FIG. 2 shows another exemplary embodiment of the invention, which is similar to the aforedescribed embodiment shown in FIG. 1B, but having the order of layers wherein the UTL, the thin dielectric film, and the conducting stubs are disposed on the substrate 100 reversed. In this embodiment, a signal conductor 220 and ground conductors 210 and 230 of a UTL 205 are disposed on the substrate 100 under the thin dielectric film 160, while a first microstrip conductor 241 and a second microstrip conductor, which is not shown, of the TFMS shunt stubs providing the capacitive loading to the UTL 205 are disposed in a top layer over the thin film 106.

Figure 3A:
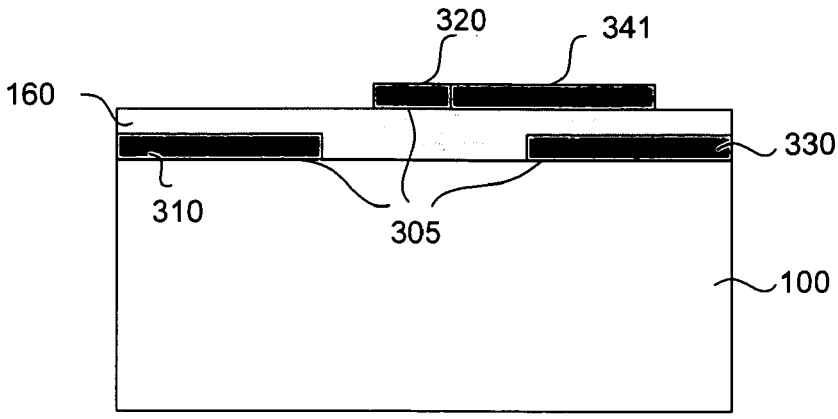
FIG. 3A is a diagram of a cross-sectional view of a capacitively loaded transmission line with signal conductors of the uniplanar transmission line and the TFMS shunt stubs disposed in the same layer.
Figure 3B:
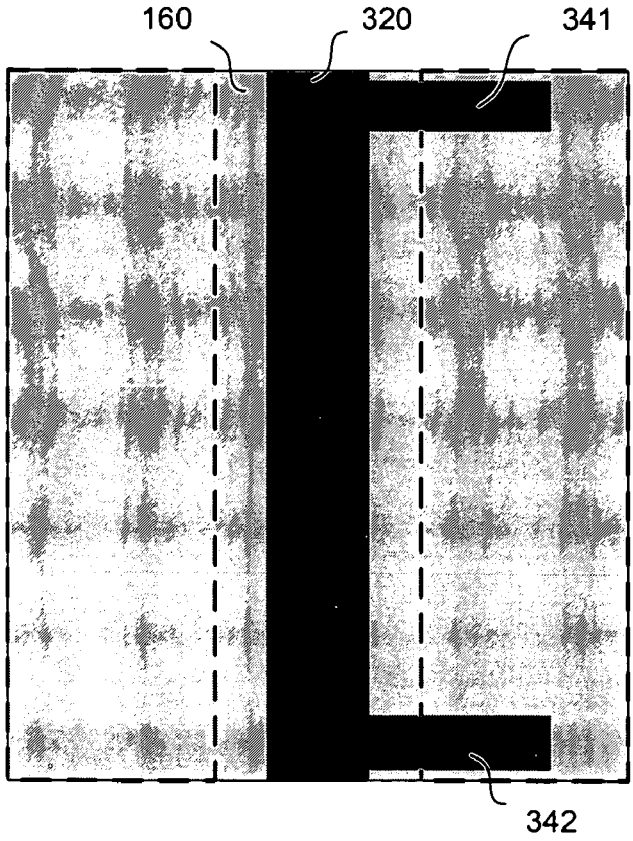
FIG. 3B is a diagram of a top view of the capacitively loaded transmission line shown in FIG. 3A.

FIGS. 3A and 3B illustrate another embodiment of the aforedescribed passive network shown in FIGS. 1A, 1B and 2. In this embodiment, an UTL 305 is a planar waveguide formed by a signal conductor 320 and two ground conductors 310 and 330, and wherein the signal and ground conductors are disposed in different layers on opposite sides of the thin film 160. Electrical properties of such a microwave waveguide can closely approximate electrical properties of a standard CPW, if the vertical offset between the ground and signal conductors of the UTL shown in FIGS. 3A and 3B, which is defined by the thickness of the thin film 160, is very small compared to widths of the signal 320 and ground 310, 330 conductors of the UTL, and to the wavelength of the microwave signal. In this embodiment, the microstrip signal conductors 341 and 342 can be disposed in the same layer as the signal conductor 320 extending directly from the signal conductor 320 over one or both of the ground conductors 310 and 330, eliminating the need for an interconnect. The order of layers wherein the signal conductor 320 and the ground conductors 310, 330 plus the microstrip conductors are disposed on the substrate can be reversed.

In other embodiments of this passive network, the UTL can be a coplanar stripline (CPS) formed by one signal conductor and one ground conductor having substantially equal widths, or an asymmetric stripline (ACPS) formed by a signal conductor and a ground conductor of different widths.

The aforedescribed embodiments provide a basic passive network of the present invention, formed by a two-port UTL and two TFMS shunt stubs capacitively loading opposing ends of the UTL; advantageously, this network emulates electrical performance of a uniform UTL in a more compact footprint. Of course, in particular circuits many variations of this basic network and changes thereto are possible as will be understood by those skilled in the art, for example depending on a type of connection thereof to other parts of the circuit and on surrounding circuit elements.

Figure 4:
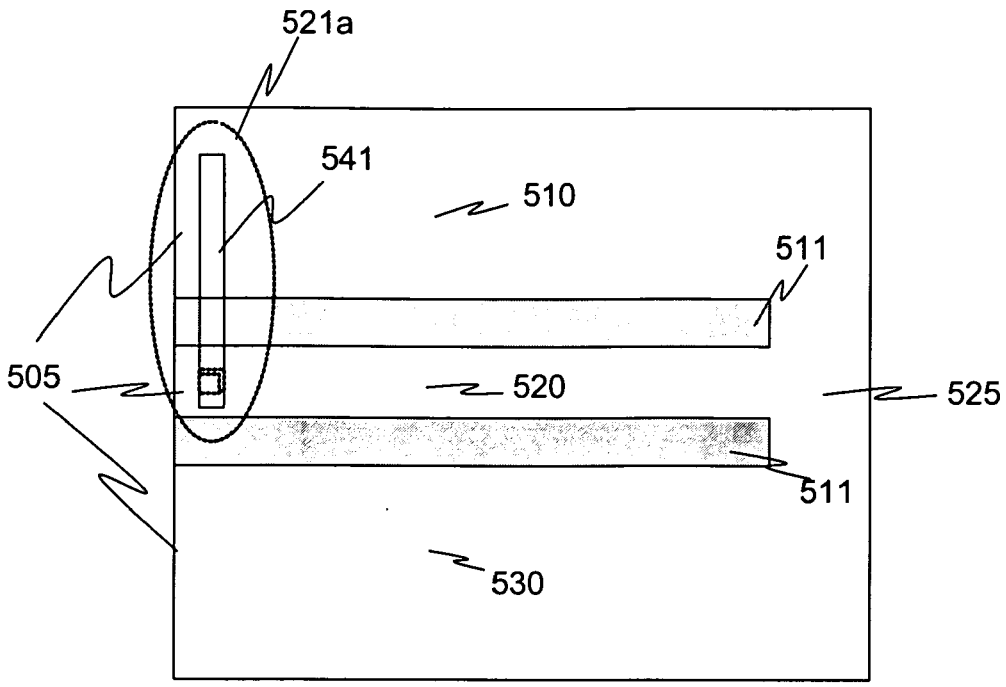
FIG. 4 is a diagram of a CPW transmission line short-circuited at one end and capacitively loaded at the other end with a TFMS stub using the CPW ground conductor as ground.

In FIG. 4, an embodiment is shown wherein one of the ends of a UTL 505 is shorted by a interconnecting it signal conductor 520 and ground conductors 510, 530 with a metal interconnect 525 forming a short circuit. The signal conductors 520 and the ground conductors 510 and 530 are separated from the signal conductor 520 by gaps 511. The short-circuited UTL 505 forms a size-reduced uniplanar short circuit (s/c) stub that is capacitively loaded by a TFMS shunt stub 521*a* to increase its electrical length to a target value $\theta_0$. Note that in this case a second TFMS shunt stub at the short-circuited end of the UTL is redundant and can be omitted since it would be shorted out by the short circuit 525. Therefore, a single TFMS shunt stub is used at the opposite to short-circuited end of the UTL 505. The single TFMS shunt stub has the electrical length θs and the characteristic capacitance Zs which are related to the electrical length $\theta_1$ and the characteristic capacitance $Z_1$ of the UTL 505 and to the target parameters $\theta_0$ and $Z_0$ of the loaded transmission line as defined by expressions (3) and (4). The CPW transmission line 505 could be an ACPS transmission line if one of the ground conductors 510 and 530 is removed.

The microstrip conductor of a TFMS shunt stub may be oriented in any direction under or over vertically offset portions of the UTL that provide the second TFMS conductor, and may either be connected to a ground conductor of the UTL and coupled to a portion of the signal conductor, or vice versa it can be connected to a signal conductor and coupled to a portion of the ground conductor as shown for example in FIGS. 1A and 1B. In some embodiments, a UTL includes an airbridge interconnecting its ground conductors or different portions or segments or lengths of its ground conductors to equalize their potentials, and the microstrip conductor can be attached to the airbridge, electrically connecting therethrough to the ground conductors of the UTL. Note that the term "airbridge" is not limited to and should not be understood as necessarily connecting means disposed in the air. For example, in the embodiment shown in FIGS. 1A, 1B and 2, an airbridge can be disposed in the same layer as the microstrip conductors, and can be connected to the ground conductors 110, 130 or 210, 230 by via conductors extended through the dielectric film 160; or for the embodiment shown in FIGS. 3A and 3B, an airbridge can be disposed in the same layer as the ground conductors 330 and 310.

Figure 5:
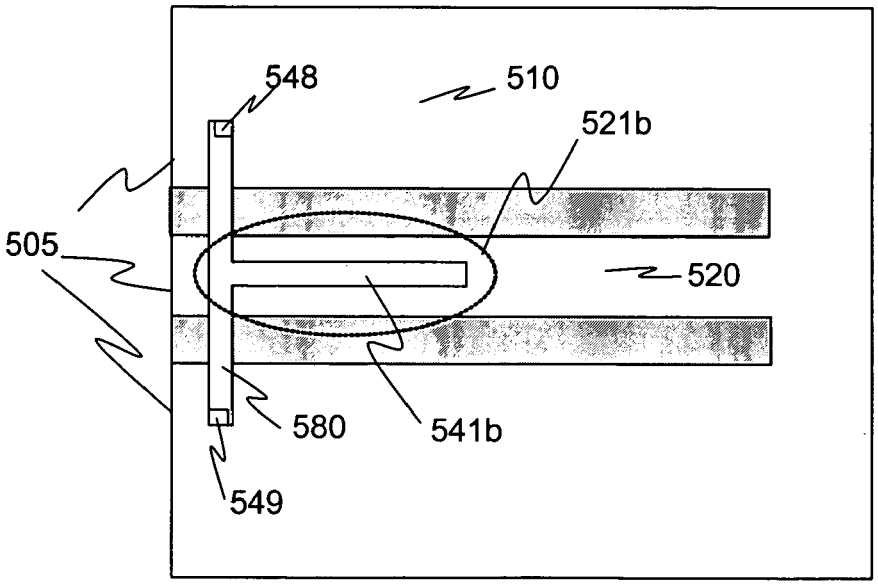
FIG. 5 is a diagram of a CPW transmission line short-circuited at one end and capacitively loaded at the other end with a TFMS stub formed by the CPW signal conductor and the microstrip conductor.

The aforedescribed embodiments employ TFMS shunt stubs electrically connected to the UTL signal conductor and sharing ground conductors with the UTL. FIG. 5 illustrates a configuration wherein a microstrip conductor 541*b* is electrically connected to the ground conductors of the CPW UTL 505, is positioned over or under the UTL signal conductor 520 and coupled thereto for forming a TFMS shunt stub 521*b*. The short-circuited UTL 505 is thereby capacitively loaded by the TFMS shunt stub 521*b* and forms a size-reduced uniplanar s/c stub. In this embodiment, the TFMS shunt stub 521*b* is formed by the microstrip conductor 541*b*, which is disposed under and along the signal conductor 520, coupled thereto through a thin film, and is electrically connected and joined at one end to an airbridge 580. The airbridge 580 interconnects the ground conductors 510 and 530 of the short-circuited UTL 505 via conducting vias 549 and 548 for equalizing electrical potentials of the interconnected portions of the ground conductors 510 and 530.

Size-reduced UTLs capacitively loaded by TFMS shunt stubs in accordance with present invention can be connected to any appropriate circuit elements, including but not limited to capacitors, inductors, resistors, transmission lines, transistors, and diodes. The size-reduced UTLs may also be connected to other types of passive networks or transmission lines of the same or a different type, such as a microstrip or a microwave waveguide, as long as appropriate known transitions are used.

The size-reduced UTLs can also be a part of a larger transmission line, for example as a size-reduced uniplanar s/c stub. Depending on how the size-reduced uniplanar s/c stub is connected to the circuit, either in series or as a shunt, physical layout of a corresponding network may be different. For example, layouts wherein standard CPW or ACPS shunt stubs are realized either inside or outside the center conductor are known in the art. The same is true for CPW or ACPS series stubs, and all of these realizations of CPW stubs may be size-reduced using TFMS shunt stubs. FIGS. 6–9 schematically show several such embodiments.

Figure 6:
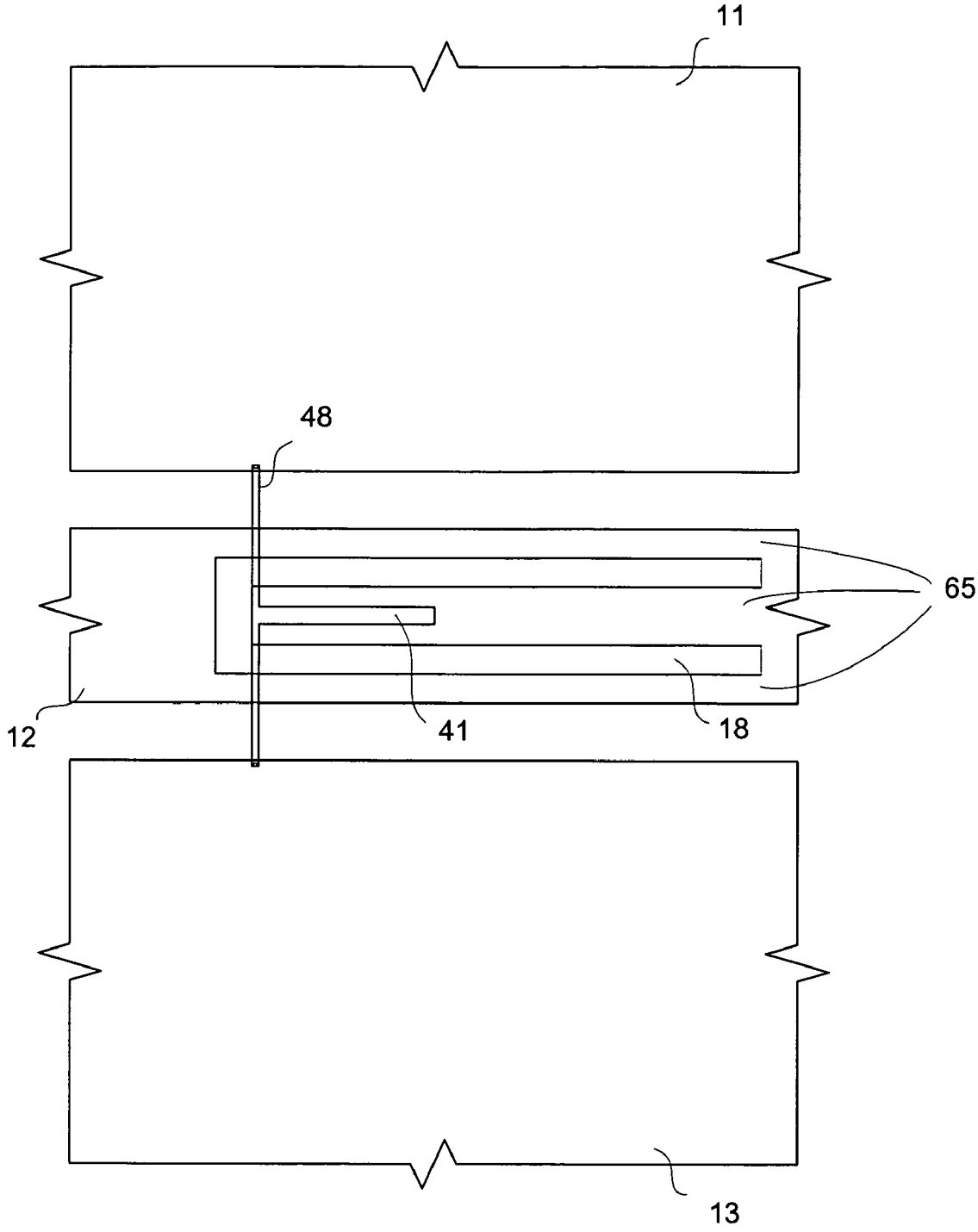
FIG. 6 is a diagram of a capacitively loaded CPW shunt short-circuit stub implemented in a center conductor of a CPW transmission line
Figure 7A:
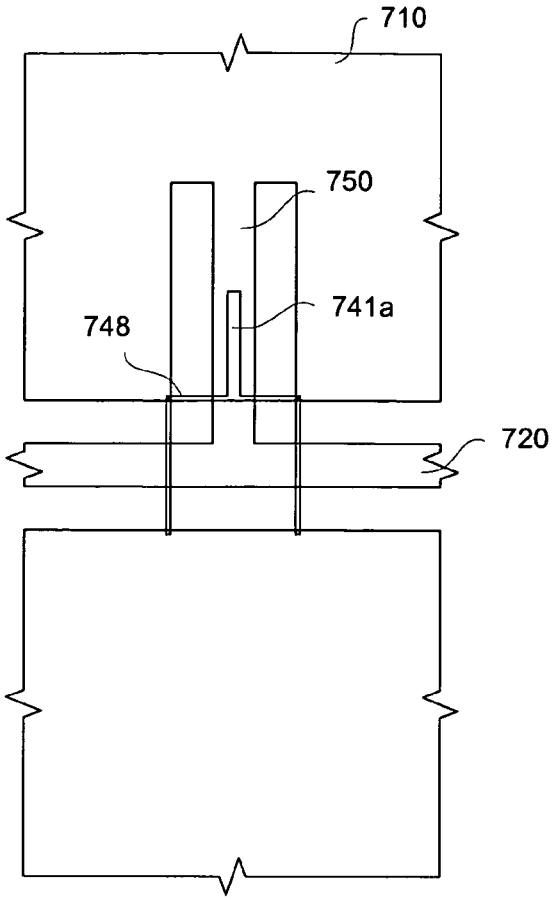
FIG. 7A is a diagram of a capacitively loaded CPW short-circuited shunt stub implemented in a ground conductor of a CPW transmission line with a microstrip conductor over a center conductor of the CPW stub.
Figure 7B:
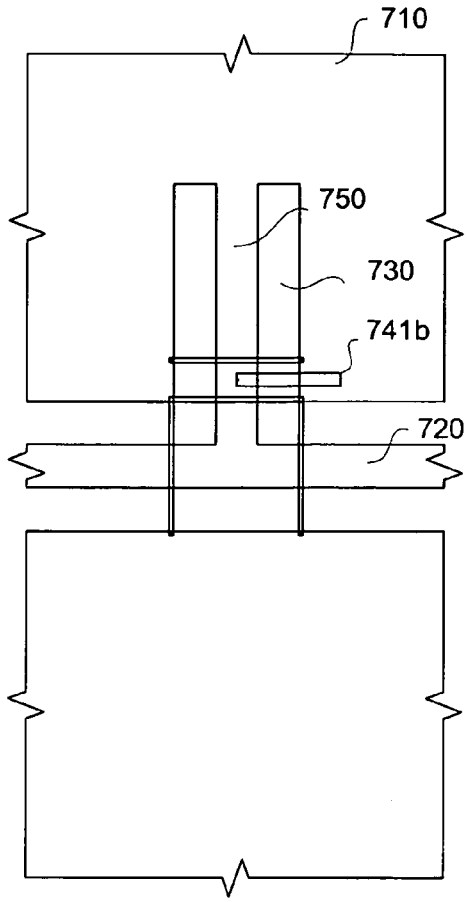
FIG. 7B is a diagram of a capacitively loaded CPW shunt short-circuit stub shown in FIG. 7A with a microstrip conductor over a ground conductor of the CPW shunt stub.

FIG. 6 shows an embodiment wherein a TFMS shunt stub 41 connected to an airbridge 48 is used for size reduction of a s/c CPW shunt stub 65. The s/c CPW shunt stub 65 is formed in a central conductor 12 of the CPW transmission line FIG. 7A schematically shows an embodiment wherein a microstrip conductor 741*a*, connected to an airbridge 748, forms a TFMS shunt stub with a s/c CPW shunt stub 750 and is used for size reduction thereof. FIG. 7B shows a similar configuration but having a differently realized TFMS shunt stub formed using a microstrip conductor 741*b*, which is connected to the central conductor of the s/c CPW shunt stub 750 and is oriented perpendicularly thereto crossing one of the conductor gaps 730 for coupling to a portion of the vertically offset ground electrode 710. In fact, any orientation of TFMS stub 741*a* is possible as long as proper TFMS and CPW mode propagation is maintained.

Figure 8:
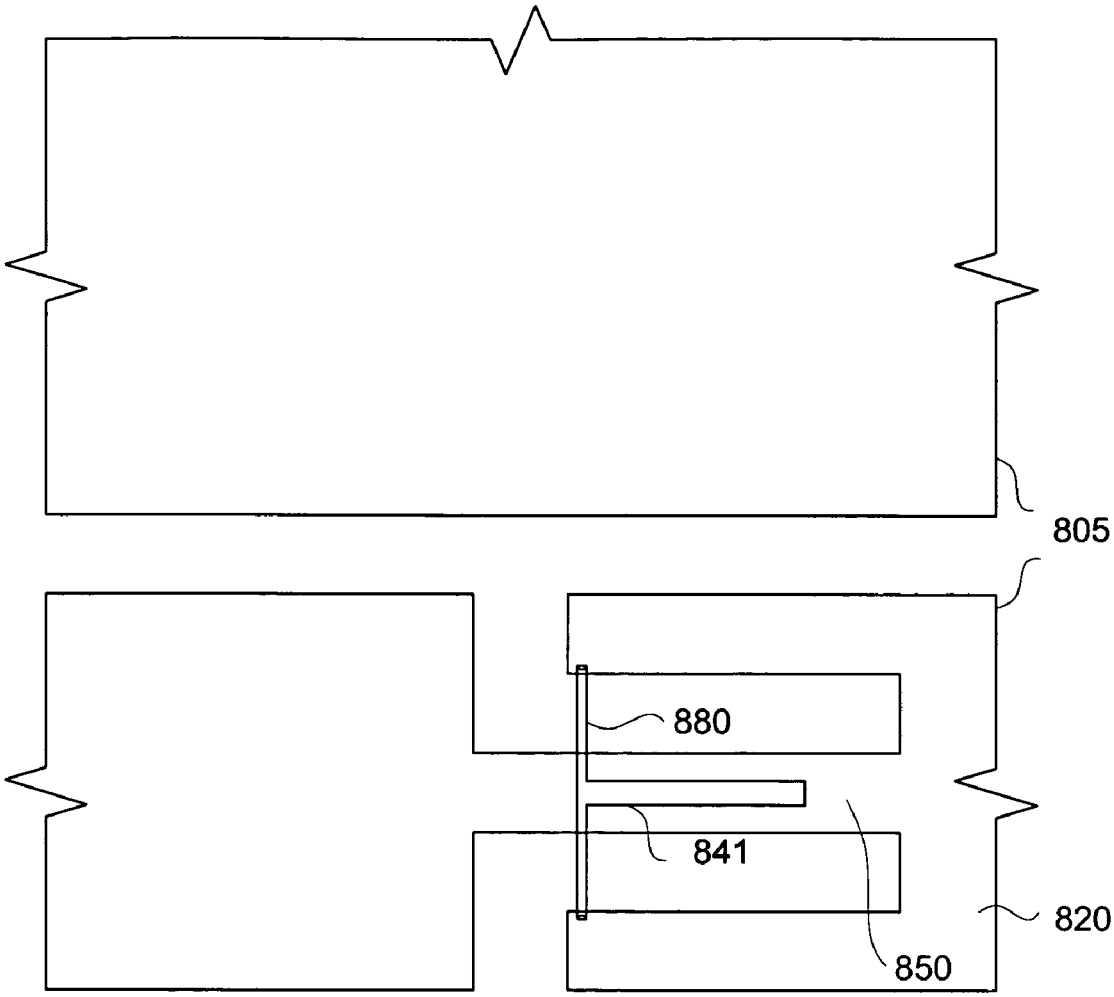
FIG. 8 is a diagram of a capacitively loaded CPW series short-circuited stub implemented in the signal conductor of a ACPS transmission line.
Figure 9:
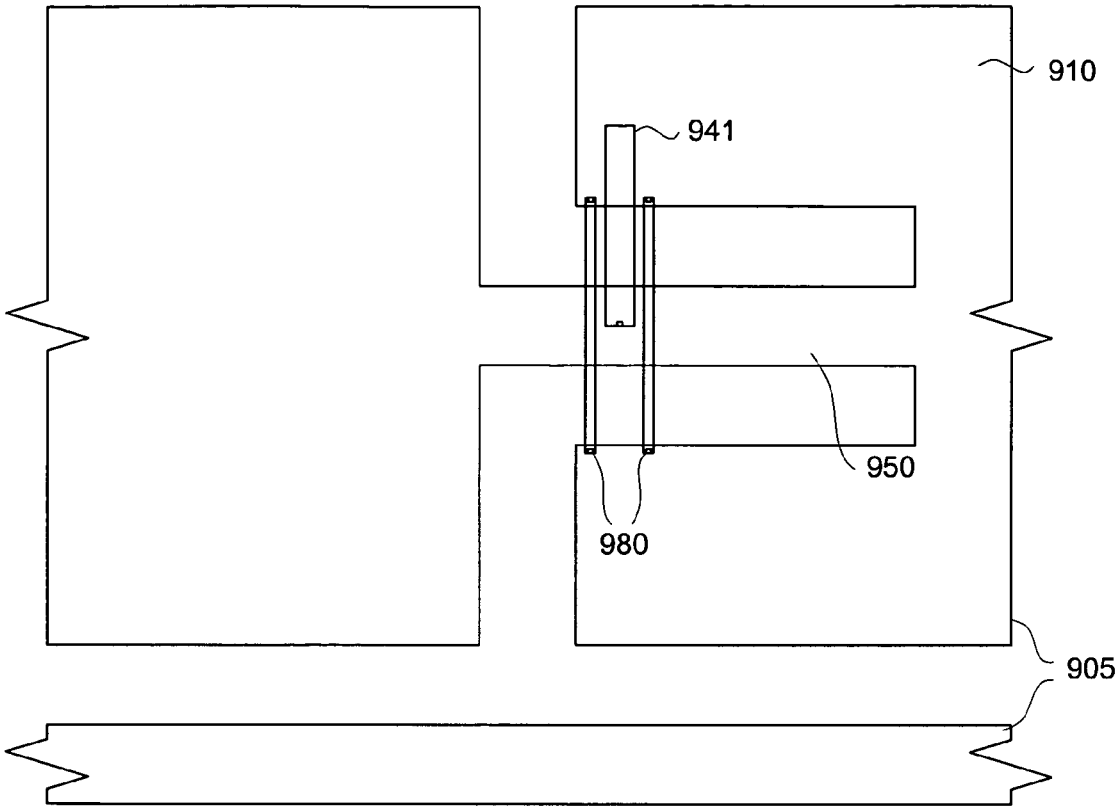
FIG. 9 is a diagram of a capacitively loaded CPW series short-circuited stub implemented in a ground conductor of a ACPS transmission line.

FIGS. 8 and 9 illustrate embodiments wherein TFMS shunt stubs are used for size reduction of CPW series stubs realized in ACPS transmission lines. In the embodiment shown in FIG. 8, a size-reduced CPW series stub 850 is formed within a signal conductor 820 of the ACPS transmission line 805. This size-reduced CPW series stub 850 is capacitively loaded by a TFMS shunt stub formed by a vertically offset microstrip 841, which is oriented along a centre conductor of the CPW series stub 850 and is connected to an airbridge 880 interconnecting two ground conductors thereof.

In the embodiment shown in FIG. 9, a size-reduced CPW series stub 950 is formed within a ground conductor 910 of an ACPS transmission line 905. The size-reduced CPW series stub 950 is capacitively loaded by a TFMS shunt stub 941 connected to a centre conductor of the CPW series stub 950. Airbridges 980 connect two ground conductors of the CPW series stub 950 formed in the ground conductor 910 of the ACPS transmission line 905.

Note that the microstrip conductors of the TFMS shunt stubs shown in FIGS. 5A, 5B, 6, 7A, 7B, 8 and 9 are disposed in a layer which is vertically offset from the corresponding transmission lines and is separated therefrom by a thin film dielectric or other suitable semi-insulating or insulating material which is not shown in the figures.

In another embodiment of this invention, two or more TFMS shunt stubs can be combined in a single TFMS shunt stub if the two or more TFMS shunt stubs are connected in parallel at a substantially same location or at adjacent electrically shorted locations in a circuit, as it is common in the art. For example, in embodiments having a second UTL electrically connected to the first UTL at their ends, a single TFMS shunt stub can be employed to replace two shunt stubs capacitively loading joined ends of the two different UTLs.

Figure 10:
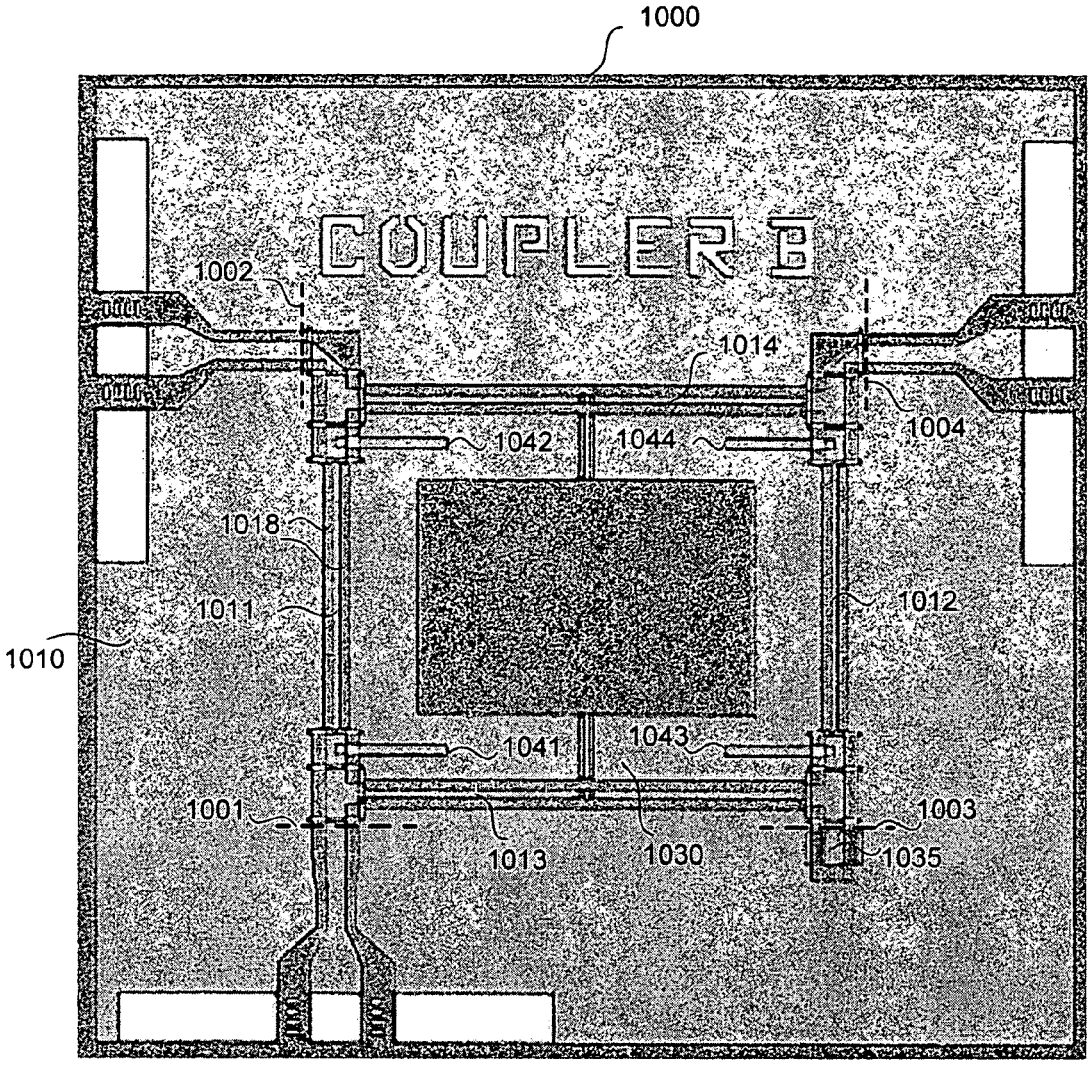
FIG. 10 is a photograph of a size-reduced branchline coupler.

This aspect of the invention is illustrated in FIG. 10, which shows a passive network wherein four UTLs embodied as CPW form a size-reduced branchline coupler 1000. In the exemplary embodiment shown in FIG. 10, the coupler 1000 was implemented on a GaAs substrate using TFMS shunt stub loading to reduce its size in accordance with the present invention. By way of example, this coupler was designed for operating at a microwave operating frequency around f =44.5 GHz. The coupler has a first port 1001, a second port 1002, a third port 1003 terminated with a 50 Ohm resistive load 1035, and a forth port 1004. The ports are indicated in FIG. 10 with dashed lines labeled with respective numerals "1001" to "1004". A first, a second, a third and a forth UTLs, which are embodied as CPWs having a common ground conductor 1030, interconnect the port pairs 1001 and 1002, 1004 and 1003, 1003 and 1001, and 1004 and 1002 respectively. In FIG. 10, the first, second, third and forth UTLs can be identified by their respective signal conductors 1011 through 1014. For example, the first UTL is formed by the signal conductor 1011 and two ground conductors 1010 and 1030 separated from the signal conductor 1011 by two symmetrical gaps 1018, which are formed on both sides of the signal conductor 1011. Four microstrip conductors 1041–1044 are connected by posts, not shown, to the opposing ends of the signal conductors 1011 and 1012 of the first and second CPW UTLs; they are disposed in a layer which is vertically offset from the layer wherein the first, second, third and forth UTLs are formed, and are separated therefrom by a thin dielectric film having a thickness of 0.8 microns which is not shown.

The passive network 1000 functions as a branchline coupler if each of the four branches of the coupler has electrical characteristics approximating electrical characteristics of transmission lines having an electrical length of 90°. However, the four UTLs forming the coupler 1000 are considerably shorter and without the TFMS shunt stubs have electrical lengths less than $\pi/2=90°$. For the exemplary embodiment described herein, the first and second UTLs 1011 and 1012 have a first characteristic impedance $Z_1'$~70.7 Ohm and a first electrical length $\theta_1'$~30 deg., and the third and fourth uniplanar transmission lines 1013 and 1014 have a second characteristic impedance $Z_1''$~70.7 Ohm and a second electrical length $\theta_1''$~45 deg. The TFMS shunt stubs capacitively load the four UTLs, increasing their effective electrical length to an increased target electrical length $\theta_0$~90°. Similar to the aforedescribed embodiments, the parameters $\theta_1'$ and $Z_1'$ of the first and second UTLs without the capacitive loading, and the parameters $\theta_1''$ and $Z_1''$ of the third and forth UTLs without the capacitive loading, are selected to satisfy expression (3) with the target electrical parameters of the capacitively loaded UTLs $\theta_0=\pi/2$ and $Z_0$=35.5 and 50 Ohms for the UTL pairs 1011, 1012 and 1013,1014 respectively. This capacitive loading of the four UTLs forming the branchline coupler allows approximately 65% reduction of the circuit area occupied by the coupler compared to a coupler without TFMS loading.

Although the coupler 1000 is formed by four capacitively loaded UTLs each of which is similar to the capacitively loaded UTL 105 of the first exemplary embodiment shown in FIGS. 1A and 1B, only four rather than 8 TFMS shunt stubs are used in the coupler 1000 to capacitively load the four UTLs at their 8 ends. This is accomplished using a single TFMS shunt stub to capacitively load two UTLs at their connecting ends, following a known in the art technique of combining capacitive loads connected in parallel at one location or at different but electrically shorted locations. Further details describing this embodiment are given in a paper by Hettak et al entitled "A novel compact multi-layer MMIC CPW branchline coupler using thin-film microstrip stub loading at 44 GHz", 2004 IEEE International Microwave Symposium, which is incorporated herein by reference.

The aforedescribed embodiments of the invention provide compact passive networks, wherein a size reduction is achieved by employing short UTL, which, when combined with TFMS shunt stubs, within a frequency range of operation have electrical characteristics of longer uniform UTLs of a target electrical length $\theta_0$.

Accordingly, in another aspect of the present invention a method is provided for increasing an electrical length of a uniplanar transmission line at an operating frequency f to a pre-determined increased electrical length $\theta_0$ from a smaller electrical length $\theta_1$.

Figure 11:
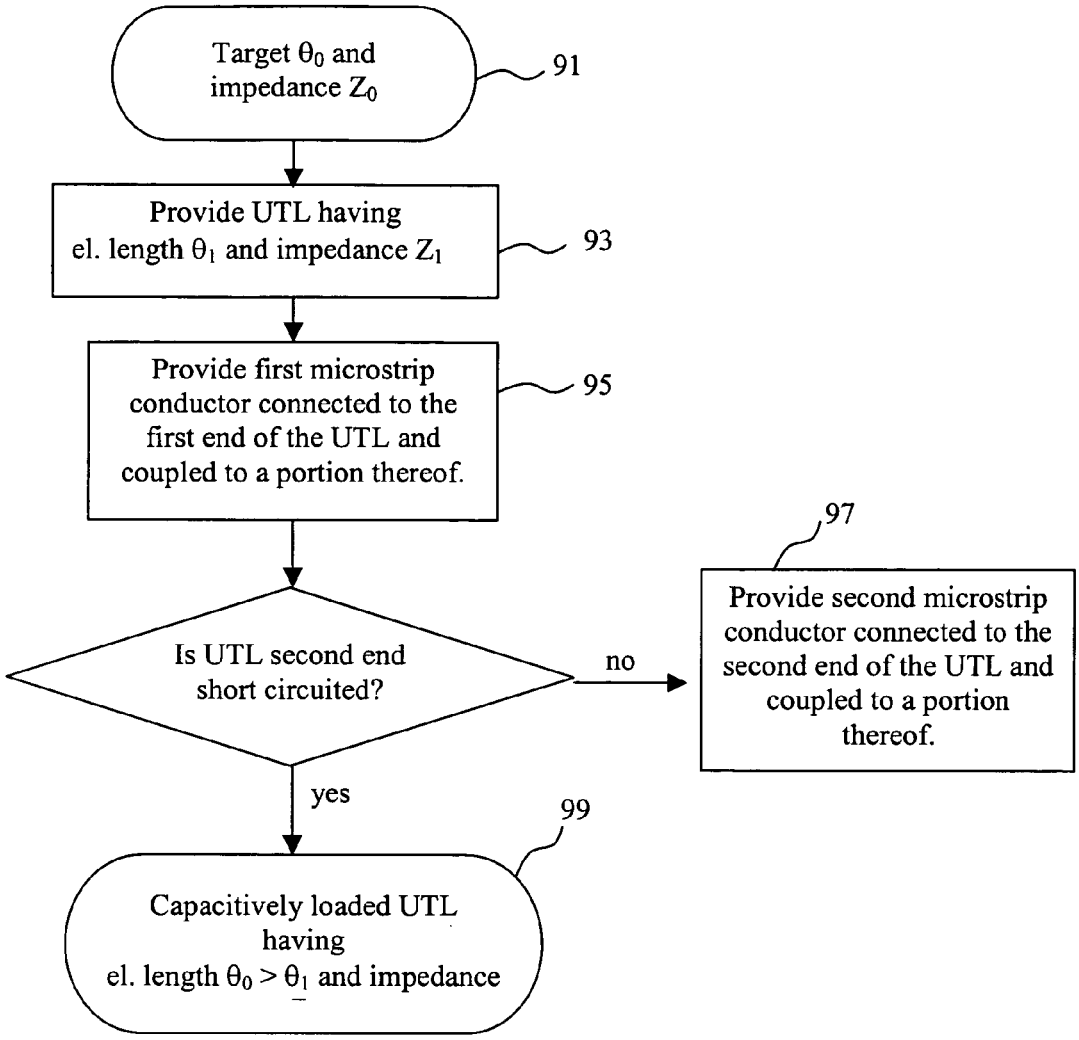
FIG. 11 is a chart of the method for increasing electrical length of a UTL in accordance with the present invention.

FIG. 11 shows general steps of an exemplary embodiment of the method. In a first step 91, target values of the pre-determined increased electrical length θ0 and a target characteristic impedance $Z_0$ of a transmission line at the operating frequency f are identified.

In a next step 93, a uniplanar transmission line is provided having at the operating frequency f a characteristic impedance $Z_1$ and the electrical length $\theta_1<\theta_0$. This step includes the steps of a) determining a target value of the characteristic impedance $Z_1$ using for example expression (3), and b) determining a physical layout of the uniplanar transmission line. Step (b) may require performing computer simulations of microwave signal propagation through the uniplanar transmission in a layout of the microwave circuit to ensure that the uniplanar transmission line, when capacitively loaded with TFMS shunt stubs at opposing ends thereof, has, at the operating frequency f, electrical characteristics approximately equivalent to electrical characteristics of a uniform transmission line having the target increased electrical length $\theta_0$ and the target characteristic capacitance $Z_0$; the approximate equivalence of electrical characteristics can be established using known in the art techniques, e.g. by comparing s-parameters of the corresponding networks or, as described heretofore in this specification, their ABCD parameters which can be simulated or extracted from measured s-parameters.

In a further step 95, a first o/c TFMS shunt stub is provided, said first o/c TFMS shunt stub comprising a first microstrip conductor vertically offset from the UTL conductors and separated therefrom by a thin dielectric film, as shown for example in FIGS. 1A and 1B. The first microstrip conductor is connected to the uniplanar transmission line at a first location at or near a first end thereof which is not short-circuited, and is oriented so that it is electromagnetically coupled to a portion of the uniplanar transmission line at a second location forming the first o/c TFMS shunt stub.

If a second end of the UTL is not short-circuited, a second o/c TFMS shunt stub is provided in a step 97, said second o/c TFMS shunt stub comprising a second microstrip conductor vertically offset from the UTL conductors and connected to the uniplanar transmission line at a third location at or near the second end thereof. The second microstrip conductor is oriented so that it is electromagnetically coupled to a portion of the uniplanar transmission line at a forth location forming the second o/c TFMS shunt stub.

Physical dimensions and layout of the first and second TFMS shunt stubs are determined from a condition that the uniplanar transmission line, when capacitively loaded with the TFMS shunt stubs at the opposing ends thereof, has electrical characteristics approximating electrical characteristics of a uniform transmission line having the target increased electrical length and the target characteristic impedance. This can be accomplished by first determining a target electrical length θs of the TFMS shunt stubs using expression (4) from the electrical length $\theta_1$, the target electrical parameters of the transmission line $\theta_0$ and $Z_0$, and from known characteristic impedance Zs of the TFMS shunt stub; and if necessary by using one of commercially available software packages for simulating electrical performance of microwave circuits to optimize and fine-tune the TFMS shunt stubs layout.

During fabrication, steps 93,95 and 97 are preferably implemented in parallel in one technological process as those skilled in the art will appreciate, wherein the multilayer passive network of present invention is fabricated by, for example, first defining physical layout of all microstrip conductors on a chip by patterning a first metallization layer disposed over the chip substrate, then deposing a thin dielectric film thereupon, patterning the thin dielectric film to form vias, deposing a second metallization layer over the thin dielectric film, and patterning thereof to form the uniplanar transmission lines and other circuit elements.

During a design stage, physical layout of the capacitively loaded UTL of the present invention and the associated TFMS shunt stubs can be determined in relation to their electrical parameters $Z_1$, $Z_s$, $\theta_1$ and $\theta_s$; those skilled in the art will appreciate that iterative computer simulations may be required to optimize the electrical performance of the network and it physical layout.

For example, in a configuration wherein neither the first nor the second end of the UTL are short-circuited, the first and second TFMS shunt stubs have preferably same electrical characteristics; however, their physical layout can differ due to parasitic effects and proximal circuit elements.

Note that the target electrical length θs of the TFMS shunt stub should be understood as an effective electrical length of the TFMS shunt stub in its electromagnetic environment and in relation to a capacitive loading it provides to the UTL. For example, it should account for electrical characteristics of interconnecting means used to connect the TFMS shunt stub to the UTL. These interconnecting means can include the aforementioned posts and airbridges; they can also be a connecting section of a uniplanar transmission line.

Figure 12:
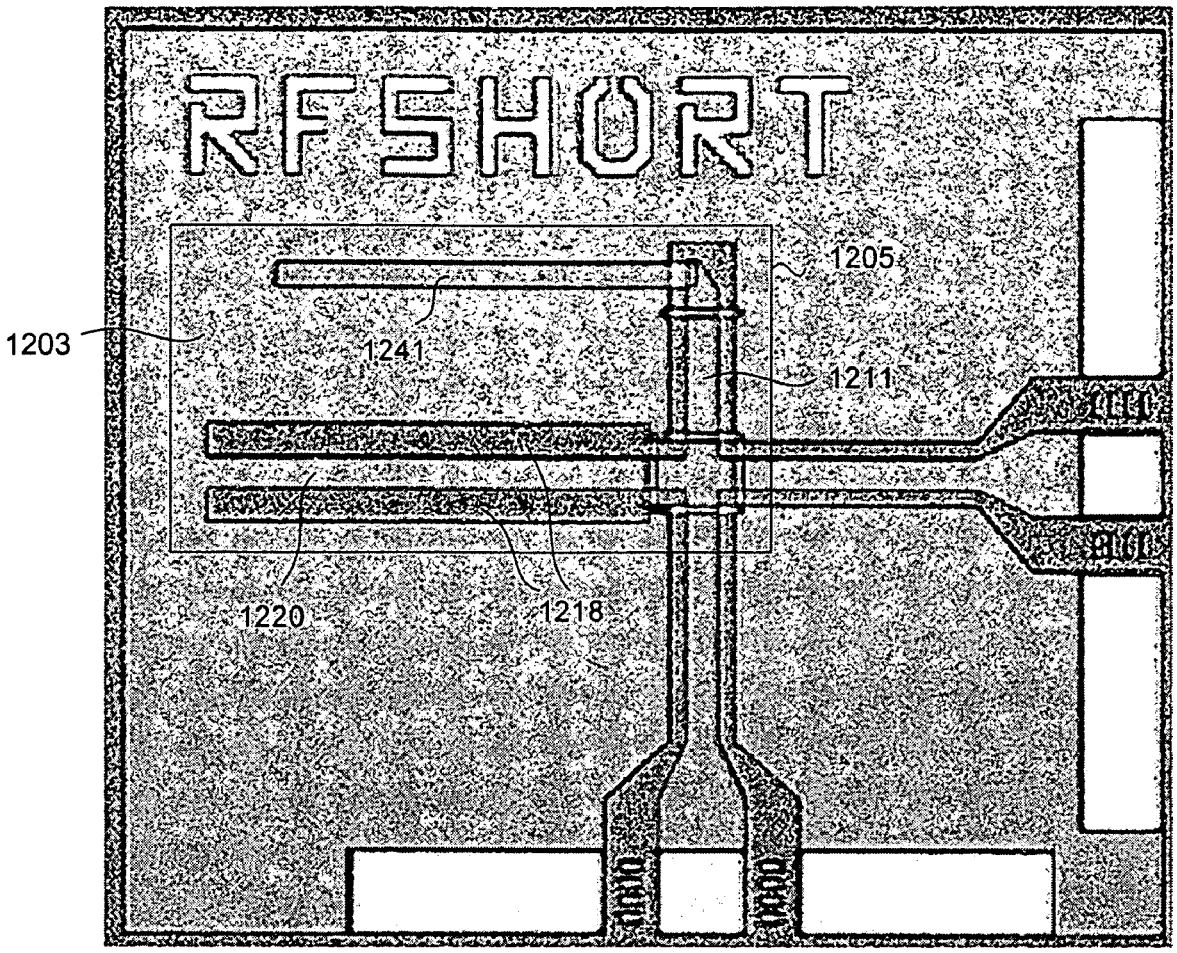
FIG. 12 is a photograph of a CPW stub capacitively loaded with a TFMS shunt stub with a connecting CPW section.

FIG. 12 shows a layout of an exemplary embodiment wherein a microstrip conductor 1241 is connected by a connecting CPW section 1211 to a centre conductor 1220 of a UTL embodied as a s/c CPW stub. This particular embodiment was implemented as a part of an active microwave circuit on a GaAs substrate. The microstrip conductor 1241 was disposed under the metal layer 1203 and separated therefrom by a thin dielectric layer. The UTL is formed by conductor gaps 1218 in the metal layer 1203. The microstrip conductor 1241 is electromagnetically coupled to an overlaying portion of the metal ground plane 1203, using it as a ground and forming thereby an o/c TFMS shunt stub capacitively loading the s/c CPW stub. The metal ground plane 1203 simultaneously provides ground for both the s/c CPW stub and the o/c TFMS shunt stub.

In summary, several exemplary embodiments of the apparatus and method of the present invention have been described. These embodiments provide physically compact multiplayer passive networks based on one or more uniplanar transmission lines, wherein the uniplanar transmission lines have electrical lengths which are increased by TFMS shunt stubs capacitively loading the ends thereof, so that the capacitively loaded uniplanar transmission lines have predetermined electrical performance approximating performance of larger uniform transmission lines.

Of course numerous other embodiments may be envisioned without departing from the spirit and scope of the invention.

What is claimed is:

1. A passive network for operating at an operating frequency f comprising a capacitively loaded transmission line, the capacitively loaded transmission line including:

a first uniplanar transmission line having a characteristic impedance $Z_1$, a first end, a second end and an electrical length $\theta_1$ therebetween;

a first microstrip conductor vertically offset from the first uniplanar transmission line, said first microstrip conductor electrically connected to the first uniplanar transmission line at one location at or near the first end and electromagnetically coupled to a first portion of the uniplanar transmission line at another location, wherein the first portion of the first uniplanar transmission line and the first microstrip conductor form a first microstrip shunt stub for capacitively loading the first uniplanar transmission line;

one of a) a short circuit electrically connected to the second end for short-circuiting the second end, and b) a second microstrip conductor vertically offset from the first uniplanar transmission line, said second microstrip conductor electrically connected to the first uniplanar transmission line at one location at or near the second end and electromagnetically coupled to a second portion of the uniplanar transmission line at another location, wherein the second portion of the first uniplanar transmission line and the second microstrip conductor form a second microstrip shunt stub for capacitively loading the first uniplanar transmission line; and, wherein, at the operating frequency f, the capacitively loaded transmission line has a pre-determined characteristic impedance $Z_o$ that is less than $Z_1$ and an electrical length $\theta_o$ that is larger than $\theta_1$.

2. A passive network as defined in claim 1, wherein the first uniplanar transmission line comprises a signal conductor and a ground conductor, and wherein said signal conductor is disposed in a first plane and said ground conductor is disposed in a second plane vertically offset and separated from the first plane by a dielectric film having a thickness of about or less than 1 micron, and wherein the first microstrip conductor is disposed in one of the first plane and the second plane.

3. The passive network as defined in claim 1 wherein the capacitively loaded transmission line constitutes a portion of a larger transmission line.

4. The passive network as defined in claim 1, wherein the first uniplanar transmission line is a short-circuited shunt stub.

5. The passive network as defined in claim 1, wherein the first uniplanar transmission line is a short-circuited series stub.

6. The passive network as defined in claim 1, further comprising a second uniplanar transmission line having an end electrically connected to the first uniplanar transmission line at the first end thereof, wherein the first microstrip shunt stub is for capacitively loading the first and second uniplanar transmission lines for forming two capacitively-loaded transmission lines.

7. A passive network according to claim 1 wherein the first microstrip shunt stub at the operating frequency f has a characteristic impedance Zs that is less than 20Ω.

8. A passive network as defined in claim 7, wherein the characteristic impedance of the first uniplanar transmission line $Z_1$ satisfies a relation $$Z_1 = Z_0 \cdot \frac{\sin(\theta_0)}{\sin(\theta_1)}.$$

9. A passive network as defined in claim 7 wherein the first uniplanar transmission line includes an airbridge electrically interconnecting sections of the first uniplanar transmission line for equalizing electrical potentials thereof.

10. A passive network as defined in claim 7 wherein the first uniplanar transmission line is one of a coplanar waveguide, a coplanar stripline, an asymmetric coplanar stripline.

11. A passive network as defined in claim 7, wherein, at the operating frequency f, the capacitively loaded transmission line is characterized by ABCD parameters of $A=\cos\theta_0$, $B=jZ_0\sin\theta_0$, $C=(j/Z_0)\sin\theta_0$, $D=\cos\theta_0$.

12. A passive network as defined in claim 7, wherein the first microstrip shunt stub at the operating frequency f has an electrical length θs substantially equal to $$\arctan\left(\frac{Z_s}{Z_1}\frac{\cos(\theta_1)-\cos(\theta_0)}{\sin(\theta_1)}\right).$$

13. A passive network as defined in claim 12 comprising the second microstrip shunt stub having the characteristic impedance Zs and the electrical length θs.

14. A passive network as defined in claim 7 wherein the first microstrip shunt stub is a thin film microstrip shunt stub comprising a thin dielectric film separating the microstrip conductor and the first uniplanar transmission line.

15. A passive network as defined in claim 14 comprising the second microstrip shunt stub, wherein the second microstrip shunt stub is a thin film microstrip shunt stub comprising a thin dielectric film separating the second microstrip conductor and the first uniplanar transmission line.

16. A passive network as defined in claim 14 wherein the thin dielectric film has a thickness of less than 1 micron.

17. A passive network as defined in claim 14 wherein the first uniplanar transmission line comprises a signal conductor and a ground conductor, and wherein the first microstrip conductor is electrically connected to one of said signal conductor and said ground conductor.

18. A passive network as defined in claim 14 wherein the first microstrip conductor is connected to the first uniplanar transmission line using one of an interconnect, a via, a connecting section of a uniplanar transmission line and an airbridge.

19. A passive network as defined in claim 14 further comprising a substrate, wherein the first uniplanar transmission line is disposed between the substrate and the dielectric film.

20. A passive network as defined in claim 14 further comprising a substrate, wherein the first microstrip conductor is disposed between the substrate and the dielectric film.

21. A method of increasing an electrical length of a uniplanar transmission line operating at an operating frequency f to an increased electrical length $\theta_0$, said uniplanar transmission line having a first end and a second end, the method comprising the steps of:

a) providing the uniplanar transmission line having a characteristic impedance $Z_1$ at the operating frequency f and an electrical length $\theta_1<\theta_0$ at the operating frequency f;

b) providing a first thin-film microstrip shunt stub electrically connected to the uniplanar transmission line at a first location at or near the first end for capacitively loading the uniplanar transmission line, said first thin-film microstrip shunt stub comprising a microstrip conductor coupled to a portion of the uniplanar transmission line at a second location;

c) providing a second thin-film microstrip shunt stub electrically connected to the uniplanar transmission line at a third location at or near the second end for capacitively loading the uniplanar transmission line, said second thin-film microstrip shunt stub comprising a microstrip conductor coupled to a portion of the uniplanar transmission line at a forth location;

wherein the characteristic impedance $Z_1$, characteristic impedances and electrical lengths of the first and second microstrip shunt stubs are such that the uniplanar transmission line and the microstrip shunt stubs at the operating frequency f form a transmission line having the increased electrical length $\theta_0>\theta_1$ between the two ends and a pre-determined characteristic impedance $Z_0<Z_1$;

and wherein the step (c) is only performed when the second end is not shorted.

* * * * *

UNITED STATES PATENT AND TRADEMARK OFFICE

CERTIFICATE OF CORRECTION

PATENT NO. : 7,190,244 B2
APPLICATION NO. : 10/990489
DATED : March 13, 2007
INVENTOR(S) : Hettak It is certified that error appears in the above-identified patent and that said Letters Patent is hereby corrected as shown below:

Title Page, section (12), "Hettak" should read -- Hettak et al. --

Title Page, section (75), "Khelifa Hettak, Nepean (CA)" should read -- Khelifa Hettak, Nepean (CA); Gilbert A. Morin, Ottawa (CA); M.G. Stubbs, Munster Hamlet (CA) --

Signed and Sealed this

Twenty-sixth Day of June, 2007

JON W. DUDAS
*Director of the United States Patent and Trademark Office*